US006447378B1

(12) United States Patent
Hoff

(10) Patent No.: US 6,447,378 B1
(45) Date of Patent: Sep. 10, 2002

(54) ABRASIVE THROWING WHEEL AND ABRASIVE THROWING BLADE

(75) Inventor: Thomas M. Hoff, Seminole, OK (US)

(73) Assignee: Disa Goff, Inc., Siminole, OK (US)

( * ) Notice: Subject to any disclaimer, the term of this patent is extended or adjusted under 35 U.S.C. 154(b) by 0 days.

(21) Appl. No.: 09/801,192

(22) Filed: Mar. 8, 2001

Related U.S. Application Data

(63) Continuation-in-part of application No. 09/709,277, filed on Nov. 13, 2000.
(60) Provisional application No. 60/187,881, filed on Mar. 8, 2000.

(51) Int. Cl.[7] ..... B24C 5/06
(52) U.S. Cl. ..... 451/95; 451/98
(58) Field of Search ..... 451/95, 98, 97, 451/96, 38; 241/275; 416/220 R

(56) References Cited

U.S. PATENT DOCUMENTS

| | | | | |
|---|---|---|---|---|
| 2,582,702 A | * | 1/1952 | Keefer | 451/98 |
| 2,696,364 A | | 12/1954 | Bartlett | |
| 2,819,562 A | | 1/1958 | Barnes | |
| 2,869,289 A | * | 1/1959 | Gossard | 451/97 |
| 2,955,799 A | | 10/1960 | Oickle, Jr. | |
| 2,970,809 A | | 2/1961 | Kroon | |
| 3,165,294 A | | 1/1965 | Anderson | |
| 3,241,266 A | * | 3/1966 | Bowling, Jr. | 451/97 |
| 3,287,858 A | | 11/1966 | Moore et al. | |
| 3,352,064 A | | 11/1967 | DeGroot et al. | |
| 3,368,308 A | | 2/1968 | Physioc, III | |
| 3,383,804 A | * | 5/1968 | Haider | 451/97 |
| 3,654,736 A | | 4/1972 | DeGroot | |
| 3,867,791 A | | 2/1975 | Goff | |
| 3,894,360 A | | 7/1975 | DeGroot et al. | |
| 4,249,350 A | | 2/1981 | Goff | |
| 4,277,965 A | * | 7/1981 | Rutten | 451/98 |
| 4,471,583 A | * | 9/1984 | Carpenter et al. | 451/97 |
| 4,649,673 A | | 3/1987 | Van Huyssteen | |
| 5,074,754 A | | 12/1991 | Violette | |
| 5,081,801 A | | 1/1992 | Fylak | |
| 5,209,024 A | | 5/1993 | Carpenter et al. | |
| 5,462,411 A | | 10/1995 | Bianchi | |
| 5,476,412 A | | 12/1995 | Stoltz | |

* cited by examiner

*Primary Examiner*—Robert A. Rose
(74) *Attorney, Agent, or Firm*—Finnegan, Henderson, Farabow, Garrett & Dunner LLP

(57) ABSTRACT

There is provided a blast wheel assembly comprising an abrasive throwing wheel and a plurality of throwing blades evenly spaced axially on the wheel. The wheel has a central opening, an outer periphery, and a plurality of channels therein for receipt of the throwing blades. The channels extend from the outer periphery with a diminishing cross-section toward the central opening. The outer periphery includes an opening for insertion of a fastener. Each of the blades comprises an inner end, outer end, a surface for throwing abrasive, and a bottom surface substantially perpendicular to the abrasive throwing surface. Each blade diminishes in cross-section from its outer end to its inner end. Each blade includes a lug disposed proximate the outer end and between the outer end and the inner end of the blade. The lug has an opening therein adapted to align with the opening in the outer periphery of the wheel when the blade is inserted in one of the channels in the wheel. Each channel and the bottom of each blade are of complementary dove tail shape so that the channel slidably receives the blade and engages the blade to securely position the blade in the channel.

5 Claims, 5 Drawing Sheets

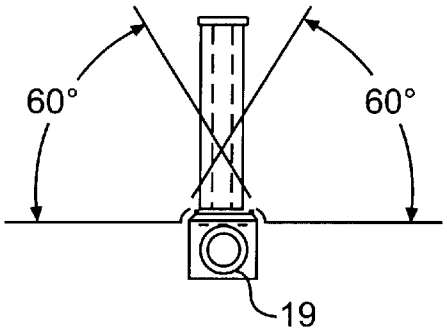
FIG. 7
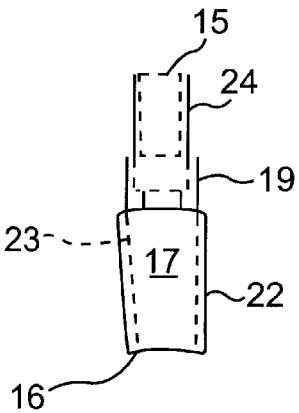
FIG. 6
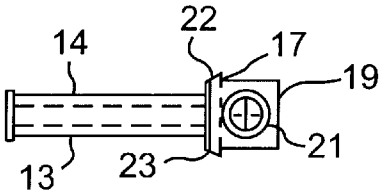
FIG. 5
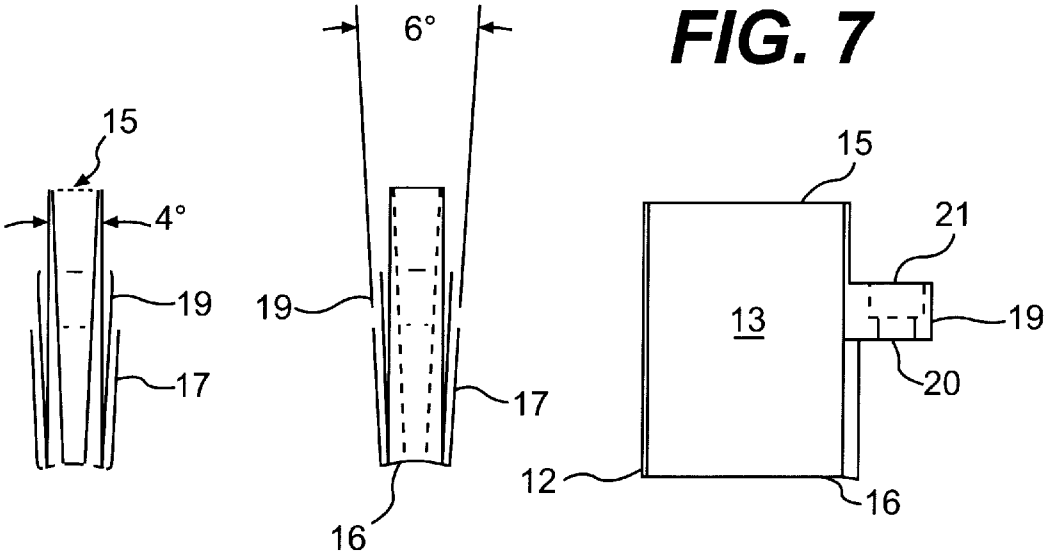

ABRASIVE THROWING WHEEL AND ABRASIVE THROWING BLADE

CROSS-REFERENCE TO RELATED APPLICATION

This application is a continuation-in-part of application Ser. No. 09/709,277, filed Nov. 13, 2000, and hereby claims the benefit under 35 U.S.C. §119(e) of U.S. Provisional Application Serial No. 60/187,881, filed Mar. 8, 2000. The entire disclosure of each is relied upon and incorporated by reference herein.

BACKGROUND OF THE INVENTION

This invention relates to a rotatable abrading device, and more particularly, to a mechanical device for propelling abrasive materials at abrading velocities against a surface to be treated. Such devices are commonly known as abrasive throwing wheels or centrifugal blasting machines. This invention also relates to an abrasive throwing blade and to an assembly comprised of the blade in position on the abrasive throwing wheel.

Centrifugal blasting machines comprising rotors or wheels having a plurality of blades installed thereon have been known in the art for many years. When the wheel is rotated at very high speeds, the blades propel an abrasive material against a work surface. The blades are sometimes referred to as abrasive throwing blades or simply throwing blades. Due to the action of the abrasive material on the throwing blades, the blades exhibit considerable wear over a period of time. Attempts have been made to fabricate the throwing blades from abrasion resistant alloys. In other cases, special blade configurations have been employed to minimize the effects of the abrasive material on the blades.

Notwithstanding these attempts to minimize wear and extend the life of the throwing blades, periodic blade removal and replacement cannot be avoided. This results in a loss of valuable operating time. Furthermore, while the blades must be removable, they must also be held securely in place such that they resist the tremendous centrifugal and other forces exerted on them when the abrasive throwing wheel is rotated at high speeds.

Several methods have been proposed for securing the throwing blades in a removable manner to the throwing wheel. One method involves securing the blades to the front side of a wheel disk, usually by means of a bolt or by means of radial grooves in the wheel, frequently of a dove tail shape. Another method employs two wheel disks that are maintained in spaced-apart relation. Longitudinal narrow edges of the throwing blades are generally inserted into radial grooves arranged in opposing surfaces of the two disks. Auxiliary means, such as bolts, pivotal locking means, eccentrics, set screws, etc. can be employed to secure the blades against radial displacement. Examples of these devices can be found in U.S. Pat. Nos. 2,819,562, 3,352,064, and 3,654,736. Blade replacement in these designs is not always easy because a number of parts must be disassembled to access the blade or because the blades may "freeze" or become jammed in the grooves in the wheel.

A number of other designs have been proposed. For example, U.S. Pat. No. 2,696,364 describes a turbine mounted on a shaft and a plurality of buckets mounted between an inner plate and an outer plate. The buckets are held between the plates by machine bolts, which pass completely through the wheel perpendicular to the plane of the wheel. The bolts clamp the plates and grip the turbine buckets between teeth formed on roots of the buckets and on peripheral marginal faces of the plates.

U.S. Pat. No. 2,955,799 describes a rotor including a hub and a plurality of blades circumferentially spaced about the hub. Interengaging means mount the blades in the hub with axial play therebetween. The blades have roots, and the interengaging means include a single pin support connecting the root of each blade to the rotor.

U.S. Pat. No. 2,970,809 relates to a rotor structure having a rim portion with a recess that receives a radially extending blade. The blade has a root portion of less thickness than the width of the recess. Thus, the blade is loosely received in the recess. A pin is provided for insertion in the rim and through the root portion for supporting the blade.

U.S. Pat. No. 3,165,294 relates to a rotor drum provided with a plurality of axially spaced, circumferentially extending slots of dovetail shape. A loading recess is provided in the radially inward wall of the dovetail slot. A radially extending threaded or tapped hole is provided adjacent the loading recess, a threaded member of plug being received therein. The head of the threaded plug is provided with a recess for receiving a tool, such as an Allen wrench, for screwing the threaded plug into and out of the tapped hole.

U.S. Pat. No. 3,287,858 describes a blasting wheel, which supports in vane channels a vane secured to a steel backing plate, which is, in turn, anchored to a channel in the wheel by bolts in a block that is integral with the plate or secured thereto. A positioning pin is used to position the backing plate in the vane channel. The vane face also is connected with the backing plate by a pin that seats in an opening in the backing plate. The pin serves as a positioning element and a reinforcement against centrifugal force developed during operation of the wheel. The pin connection prevents the plate and vane from sliding axially following development of centrifugal force.

U.S. Pat. No. 3,368,308 relates to a throwing wheel and a shaft rotatably mounted on suitable journals and carrying a runner head upon which throwing blades are mounted. The blades are equally spaced around the runner head and can be held in any suitable manner, such as by use of an enlarged dove tailed edge on one side of the blade engaging a corresponding dove tailed slot in the face of the runner head.

U.S. Pat. No. 3,867,791 describes a throwing blade that is secured to a wheel by means of a blade block, which is mounted on the wheel. The blade block has a first groove near an inner end of the block and a second groove near an outer end. The blade includes lugs for insertion in the grooves. A centrally disposed impeller restricts movement of the blades, particularly in a radial direction. The blades are thus maintained in a fixed position on the blade blocks. While commercial success has been achieved with this device, the rear of the blade must generally be machined in the area where it contacts the impeller. This adds to the cost of the blade. Additionally, it is rather difficult to cast a blade of the type disclosed in the patent because of its large cross-sectional area.

Another arrangement is shown in U.S. Pat. No. 3,894,360. In this design, the blades are mounted on brackets having an angular cross-section, and the brackets, in turn, are mounted on the throwing wheel. The rear of each blade is provided with a cast-in insert stud, which is adapted for insertion through an opening in the angular bracket. The stud is provided with a slot adapted to receive a clip, which holds the blade in position on the angular bracket. The only securing means in this arrangement is comprised of the stud and the spring clip. Should either the stud or spring clip fail, such as by wear around the area of the stud, the blade may fly off the wheel.

U.S. Pat. No. 4,249,350 provides, in combination, a blade block adapted for mounting on an abrasive throwing wheel and a blade supported by and detachably connected to the blade block. The blade has an inner end, an outer end, a forward surface and a rear surface. Cooperating engagement means are provided on the blade block and the blade for permitting inward movement of the blade while preventing substantial outward movement thereof relative to the blade block. An abutment means on the blade block acts as a bearing or driving surface for the blade. The abutment surface is located outwardly of the engagement means and usually contacts the rear surface of the blade. The abutment means substantially prevents rearward movement of the blade without obstructing its forward movement. Locking means substantially prevents inward movement of the blade relative to the blade block in order to prevent disengagement of the cooperating engagement means.

U.S. Pat. No. 4,649,673 describes a shot blasting wheel having a base plate with angularly spaced, elongated grooves that engage complementary tongue formations on throwing blades. A rearwardly directed lug is provided on each blade, which is engaged by a bolt or stud, which is parallel to the surface of the blade and enters the wheel normal to the plane of the wheel. The lug includes a wedging surface, which results in a force on the lug to lock the tongue formation in the groove. The interengaged tongue and groove are shielded against the ingress of shot.

U.S. Pat. No. 5,074,754 describes a rotor blade, which is releasably connected to a closed-sided retention member. The retention member is releasably affixed to a rotatable hub. A shaped root of the rotor blade is retained within the closed-sided retention member by a shaped flange and a shaped retention plate. The shaped root of the rotor blade is secured within the retention member without a direct bolted connection.

U.S. Pat. No. 5,081,801 relates to a blast wheel provided with a plurality of blades having generally an "I" shape in cross-section, each blade includes a base having a hooking member at one end for anchoring with the wheel. The opposite end of the blade from the hooking member is provided with a lug extending downwardly from the bottom surface for anchoring in the wheel after engagement of the hooking member with the wheel. The lug also extends outwardly from the end of the blade forming a bearing surface substantially co-planar with, but opposed in direction to, the bottom surface of the blade. The hooking member is inserted into the peripheral recesses of the wheel for anchoring therewith, thereby restricting axial, circumferential, and radial inward movement of the outward end of the blade.

U.S. Pat. No. 5,209,024 relates to an abrasive blast wheel comprising a combination of a hub, radially extending blades, and an impeller plate for a blast wheel. Each of the blades includes an anchoring base of a transverse width greater than a remainder of the blade. The impeller plate has a plurality of radial slots, one radial slot for each of the blades. The impeller plate is axially secured relative to the hub to axially clamp the blade bases to the hub with the blades being retained against radial outward movement by the blade anchoring base end engaging the hub flange.

U.S. Pat. No. 5,462,411 describes a blade-hub connection using an element in the shape of an "L", which is inserted into a cavity of a blade. One of the legs of the L-shaped element is substantially aligned on the longitudinal axis of the blade itself. A second, shorter leg of the L-shaped element is placed perpendicular to the plane of the blade and adapted for placement in a position parallel to the plane of the hub. A hole is made to allow for the passage of a screw, which bolts the blade attachment to the hub by passage into the hub perpendicular to the plane of the hub.

U.S. Pat. No. 5,476,412 relates to a blade for mounting on a centrifugal blasting wheel without using a separate stop member to prevent outward radial movement of the blade.

The blade replacement designs just described have several features in common. They require multiple elements for fastening the throwing blade to the abrasive throwing wheel. These elements include, for example, blade blocks, blade locking plates, and retainer clips. These designs also have special shaping and forming requirements for the throwing blades and the abrasive throwing wheel. For example, in some cases the blades must be formed with recesses and apertures for mating with corresponding elements on the abrasive throwing wheel or auxiliary parts.

Thus, notwithstanding the numerous designs for replacement of throwing blades on abrasive throwing wheels, there still exists a need in the art for improved means for securing the throwing blades to the abrasive throwing wheel of a centrifugal blasting machine. The throwing blades must be securely mounted on the wheel to prevent movement of the blades, especially in a radial direction following the development of centrifugal force by rotation of the wheel. The blades should be easily removed and replaced without the need for special tools. Preferably, the blade should not be susceptible to "freezing"0 or jamming in position, as is frequently encountered when the blades are installed in grooves on a face of the wheel. When the wheel and blade assembly is installed in a centrifugal blasting machine, it should be possible to replace the blade without removing internal parts, such as the impeller and control cage, conventionally found in such machines. The design should dispense with the need for adhesive materials that temporarily hold blades in position during assembly. The design should also dispense with the need for retaining clips and similar small fasteners that are difficult to handle and manipulate. The assembly should not require machining and close tolerances characteristic of some prior art devices. The means used for locking the blade in position should be suitable for use with any length and width of blade. For commercial reasons, the wheel and blade assembly should be adapted to fit centrifugal blasting machines now in use.

SUMMARY OF THE INVENTION

This invention aids in fulfilling these needs in the art by providing a blast wheel assembly comprising an abrasive throwing wheel and a plurality of throwing blades evenly spaced axially on the wheel. The wheel has a central opening, an outer periphery, and a plurality of channels therein for receipt of the throwing blades. The channels extend from the outer periphery with a diminishing cross-section toward the central opening. The outer periphery includes an opening for insertion of a fastener. Each of the blades comprises an inner end, outer end, a surface for throwing abrasive, and a bottom surface substantially perpendicular to the abrasive throwing surface. Each blade diminishes in cross-section from its outer end to its inner end. Each blade includes a lug disposed proximate the outer end and between the outer end and the inner end of the blade. The lug has an opening therein adapted to align with the opening in the outer periphery of the wheel when the blade is inserted in one of the channels in the wheel. Each channel and the bottom of each blade are of complementary dove tail shape so that the channel slidably receives the blade and engages the blade to securely position the blade in the channel.

BRIEF DESCRIPTION OF THE DRAWINGS

This invention will be more fully understood from the detailed description that follows and by reference to the accompanying drawings which depict an abrasive throwing wheel, a throwing blade, and a centrifugal blasting machine according to this invention, and detailed views of their various parts. In the drawings:

FIG. 5 is a front view of a throwing blade of the invention;

FIG. 6 is a side view of the throwing blade depicted in FIG. 5; and

FIG.7 is a top view of the throwing blade depicted in FIG. 5.

DETAILED DESCRIPTION OF THE INVENTION

The device of this invention comprises a rotatable wheel having a plurality of circumferentially spaced, radially extending, abrasive throwing blades removably affixed to the wheel. The rotatable wheel is referred to herein as "the abrasive throwing wheel." The removable blades are referred to herein as "the throwing blades." The assembly comprising the abrasive throwing wheel with the throwing blades affixed to the wheel is referred to herein as "the blast wheel assembly."

Figure 1:
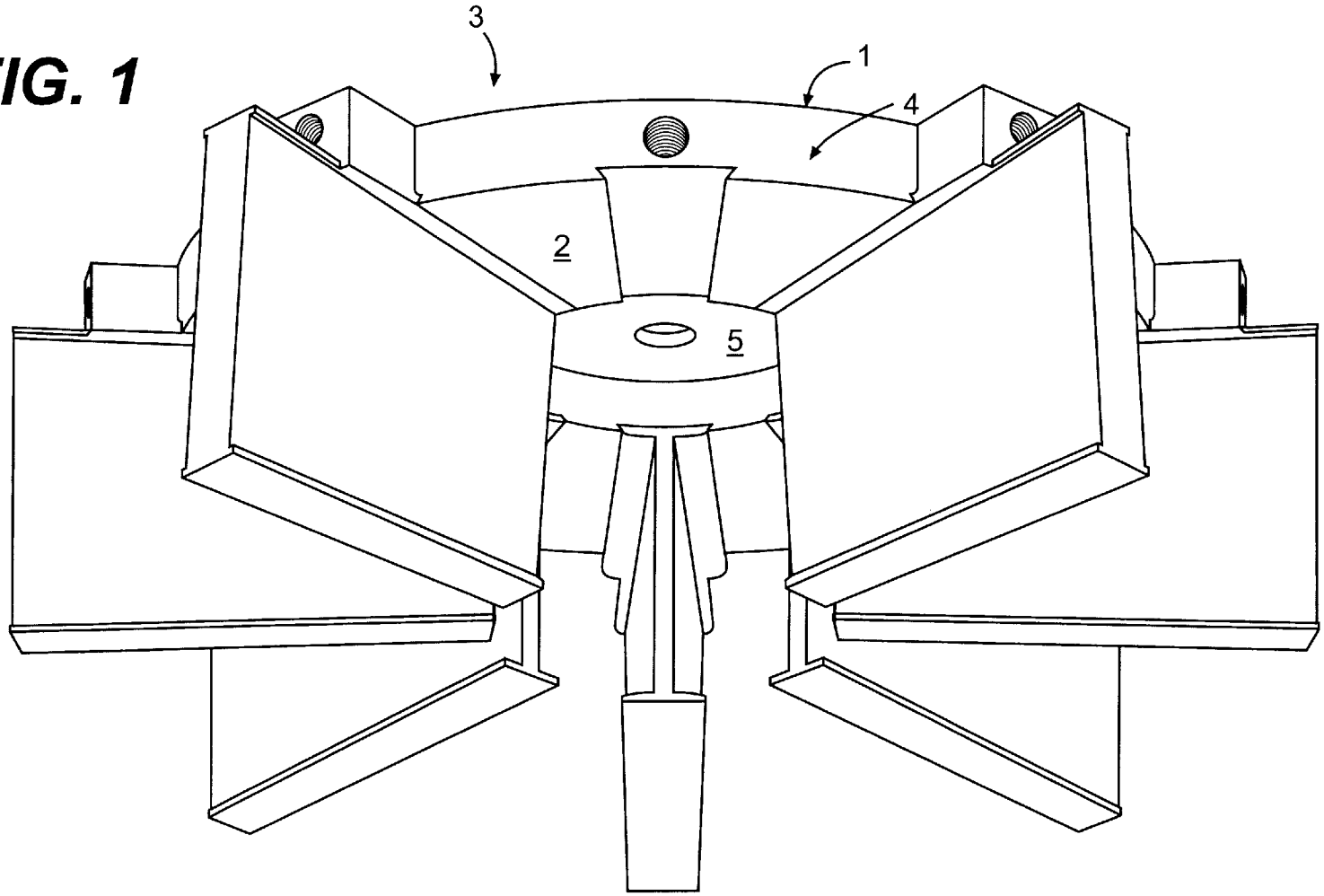
FIG. 1 is a perspective view of an abrasive throwing wheel of the invention.

One embodiment of an abrasive throwing wheel of the invention is depicted in FIG. 1. Referring to FIG. 1, an abrasive throwing wheel generally designated 1 has a planar front face 2, a planar rear face 3, and a circumferential outer face 4. The abrasive throwing wheel 1 has the shape of a substantially right circular cylinder. That is, the plane of the front face 2 and the plane of the rear face 3 are substantially parallel to each other, and the outer face 4 forms a substantially continuous, cylindrical surface around the outer periphery of the wheel 1. The device depicted in FIG. 1 is adapted for rotation in either a clockwise or a counter clockwise direction.

The abrasive throwing wheel 1 is provided with a centrally located opening generally designated as 5. Preferably, the central opening 5 is of a size sufficient to accommodate a portion of an impeller. The abrasive throwing wheel 1 has an axis of rotation, which is perpendicular to front face 2 and rear face 3. The axis of rotation passes through the center of an imaginary circle defined by the circular opening 5 and is perpendicular to the plane of the circle.

Figure 2:
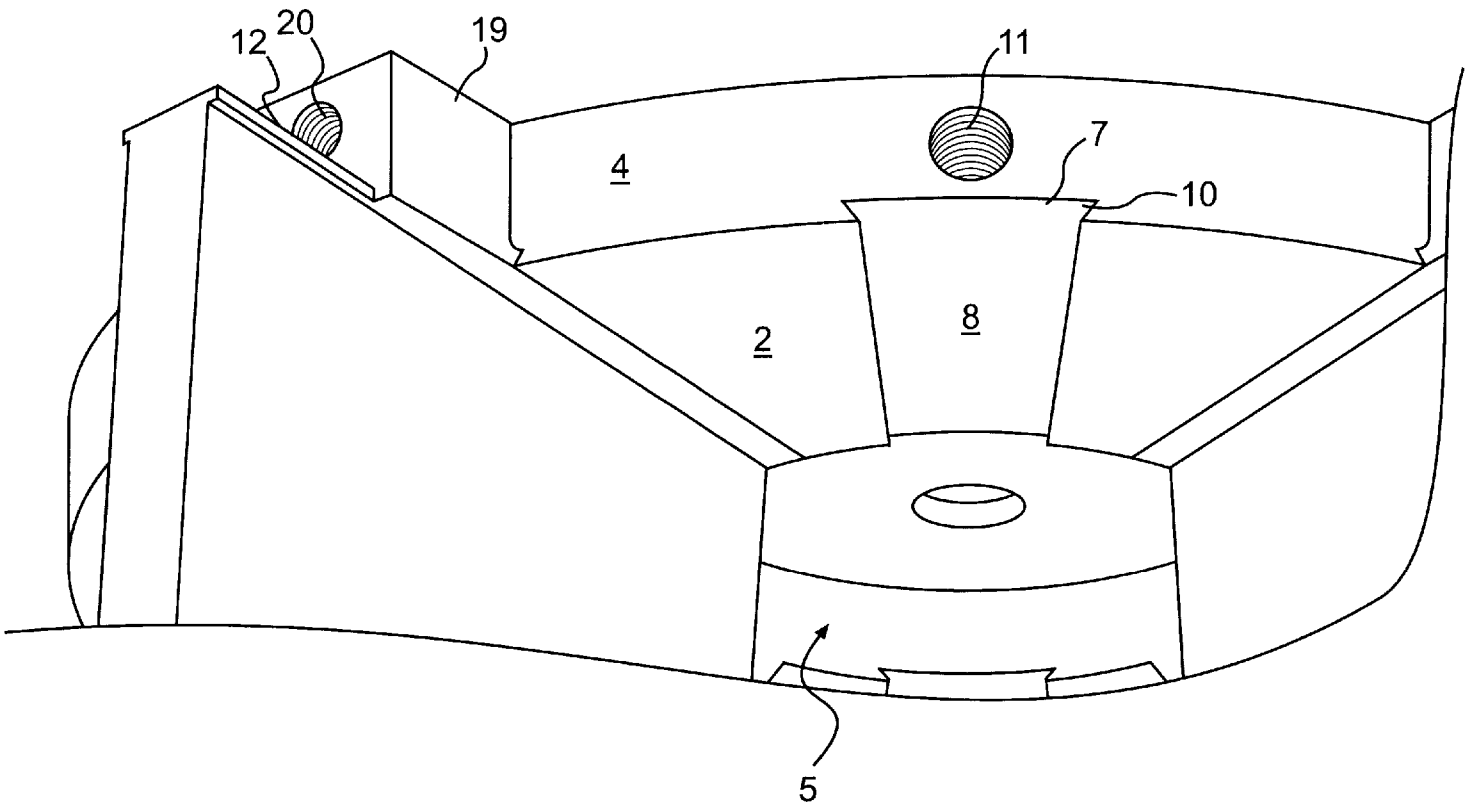
FIG. 2 is an enlarged view of a segment of the abrasive throwing wheel shown in FIG. 1.

Referring to FIG. 2, which is a close-up view of a segment of the abrasive throwing wheel 1, a channel 7 is provided through the front face 2 of the wheel 1. The channel 7 radially extends from outer face 4 of the abrasive throwing wheel 1, through the wheel, and to the central opening 5 in the wheel. The channel 7 is substantially unobstructed throughout its length.

The channel 7 is defined by a base portion 8 and side walls 9 and 10. The base portion 8 is substantially parallel to the plane of the front face 2, and side walls 9 and 10 are inclined, thereby providing the channel with a dove tail cross-sectional shape. As shown in FIG. 2, the base portion 8 of channel 7 and the side walls 9 and 10 of the channel are smooth, continuous surfaces. The channel 7 is configured to slidably receive the throwing blades of the invention, which are described in detail hereinafter.

The outer face 4 (FIG. 2) of abrasive throwing wheel 1 contains an opening 11, which is tapped to receive a bolt. The drilled opening 11 extends from the outer face 4 of the abrasive throwing wheel 1 toward the central opening 5 along a radius of the wheel 1.

Figure 3:
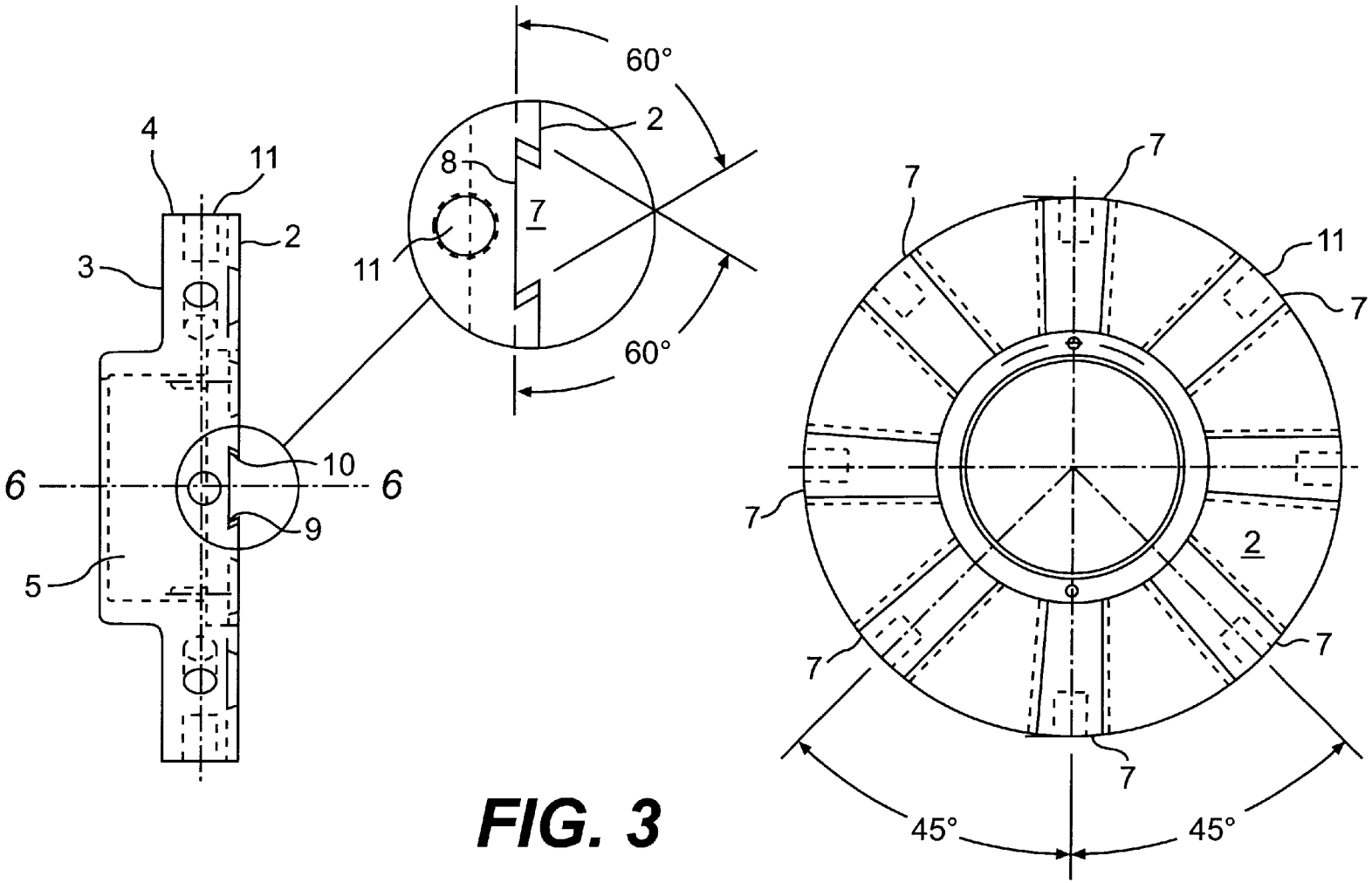
FIG. 3 is a side and top view of an abrasive throwing wheel of the invention.

Referring to FIG. 3, which is a top and side view of an abrasive throwing wheel 1 of the invention, it will be evident that the wheel 1 is provided with a plurality of channels 7. As shown in FIG. 3, seven channels, each one designated channel 7, are evenly arranged through the front face 2 of the abrasive throwing wheel 1, such that each channel is centered on a radius of the wheel 1 and the radii of the wheel are spaced 45° apart. The depth of the drilled and tapped opening 11 is shown in the FIG., where it will be apparent that each opening 11 need only partially extend from outer face 4 into the body of the abrasive throwing wheel 1.

Reference to FIG. 2 will show that the channel 7 is not of a uniform cross-section throughout its length. That is, channel 7 as shown in FIG. 2 decreases in cross-sectional area from the outer face 4 to the central opening 5 of the abrasive throwing wheel 1. This configuration is advantageous in replacing the throwing blade. A throwing blade of the invention will now be described.

Figure 4:
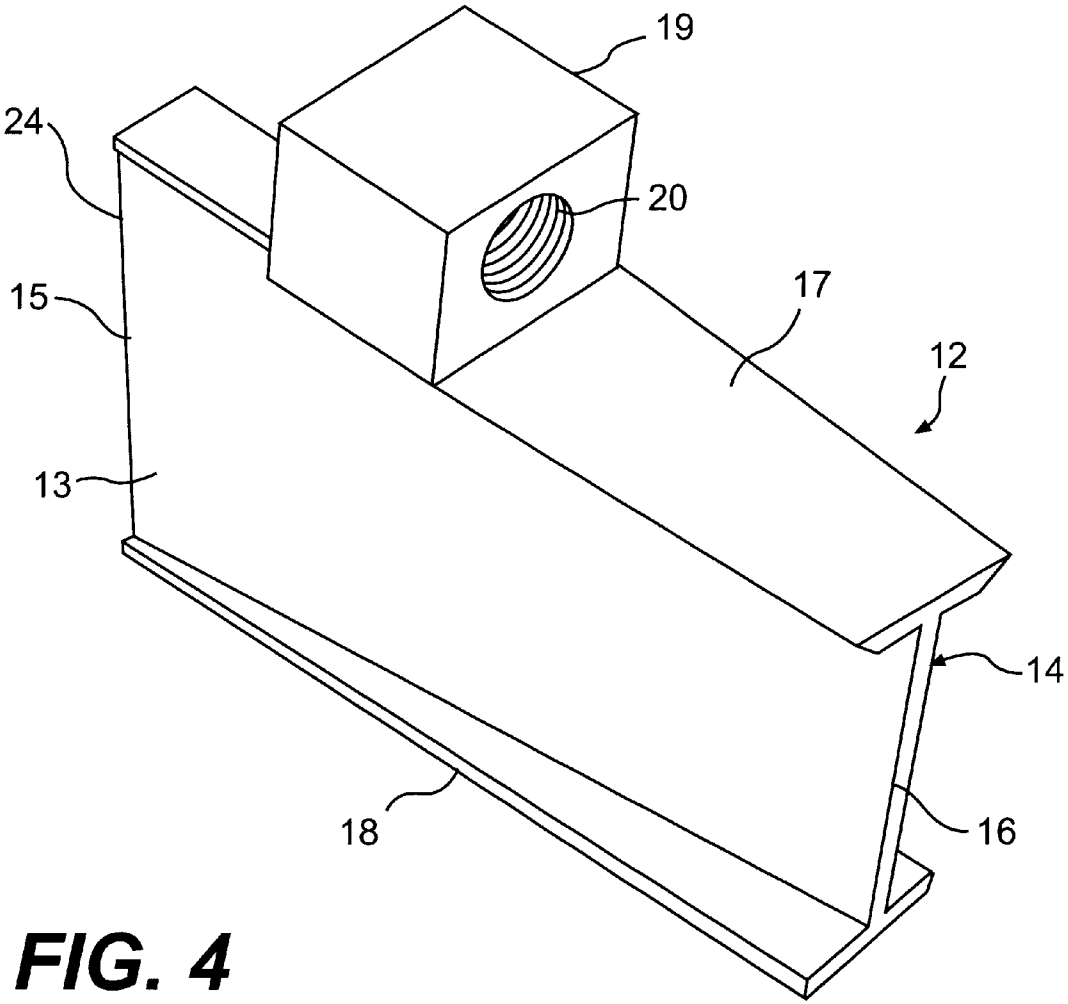
FIG. 4 is a perspective view of a preferred throwing blade of the invention.

In FIG. 4, there is depicted a preferred throwing blade of this invention. The blade, generally designated as 12, comprises an unobstructed, continuous, smooth surface 13 for throwing abrasive. Surface 13 is the front surface of the blade 12. The blade 12 also has a rear surface 14, which is hidden from view, an outer end 15, and an inner end 16.

The blade 12 depicted in FIG. 4 is in an inverted orientation; that is, the bottom surface 17 of the blade 12 is visible, whereas the top surface 18 of the blade is hidden from view. A lug 19 is provided on the bottom surface 17 of the blade 12. The lug 19 is disposed proximate the outer end 15, and between the outer end 15 and the inner end 16 of the throwing blade 12. The lug 19 contains a centrally located opening 20 therethrough. The opening 20 can include a countersunk portion 21, shown in FIG. 5, for receiving the head of a bolt, inserted from the outer end 15 of the blade 12, through the opening 20 in lug 19.

The bottom surface 17 of the throwing blade 12 depicted in FIG. 4 is a smooth, continuous surface, which tapers from the lug 19 to the inner end 16 of the blade (see FIG. 6). The taper provided on the bottom surface 17 is complementary to the taper formed by the base 8 and inclined side walls 9 and 10 of channel 7 (FIG. 1), so that channel 7 can slidably receive the bottom surface 17 of the throwing blade 12 and form a tight fit therewith.

The bottom surface 17 of the throwing blade 12 joins side walls 22 and 23, which are inclined toward the central axis of the throwing blade and in a direction toward the top surface 18 of the blade. This configuration is evident in FIG. 7. Referring to FIG. 7, the throwing blade 12 containing the lug 19 having countersunk opening 20, 21 includes inclined side walls 22 and 23. Each side wall joins the bottom surface 17 of the blade. The inclined side walls 22 and 23 are dimensioned to complement and contact the inclined side walls 9 and 10 in channel 7 when the blades are inserted in abrasive throwing wheel 1 shown in FIG. 1.

It will be evident from FIG. 4 that the throwing blade 12 of the invention also includes a portion, generally designated 24, that extends beyond the lug 19 in a direction toward the outer end 15 of the throwing blade 12. The portion 24 of the throwing blade 12, of course, comprises part of the abrasive throwing surface 13 of the throwing blade.

The throwing blade of the invention can easily be installed on the abrasive throwing wheel to form the blast wheel assembly of the invention. For example, with the abrasive throwing wheel 1 in a stationary position, a throwing blade 12 of the invention can be oriented so that its bottom surface 17 faces the base portion 8 of the channel 7 in the abrasive throwing wheel, and the inner end 16 of the throwing blade 12 is oriented for insertion into the channel 7 so that the dove tail shape of the bottom of blade 12 matches the dove tail shape of the channel 7. After sliding throwing blade 12 into channel 7, a tight fit is formed between the blade and the channel due to the complementary, diminishing, cross-sectional tapers of the throwing blade and channel.

When the blade 12 is secured in channel 7, the lug 19 on the throwing blade 12 will abut the outer face 4 of the abrasive throwing wheel 1. (See FIG. 2). In addition, the opening 20 in lug 19 on the throwing blade 12 will be aligned with the opening 11 in the outer face 4 of the abrasive throwing wheel 1. The throwing blade 12 can then be locked into position on the abrasive throwing wheel by inserting a bolt through opening 20 in the lug 19, and screwing the bolt into the tapped opening 11 in the outer face 4 of the abrasive throwing wheel.

During operation of the blast wheel assembly, the abrasive throwing wheel 1 is rotated at high speed, typically 1750 to 3600 rpm, creating a centrifugal force on the wheel and the throwing blades 12. The bolted connection between the lug 19 on the throwing blade and the outer face 4 of the abrasive throwing wheel effectively resists the centrifugal force and locks the throwing blade 12 in position on the wheel 1. Thus, the throwing blade is secured against radial displacement on the abrasive throwing wheel by this simple, yet durable, connection.

Moreover, the throwing blade is secured against circumferential displacement as the abrasive throwing wheel is rotated at high speed. This is achieved by inserting the throwing blade in the channel in the abrasive throwing wheel to form a force fit between the dove tail in the channel and the complementary surfaces on the blade.

The throwing blade is fully supported by the abrasive throwing wheel. When the abrasive throwing wheel depicted in FIG. 1 is rotated in a clockwise direction, the inclined side wall 9 of the channel 7 abuts the inclined side wall 22 of the throwing blade 12 providing a bearing surface for transmission of a driving force to cause the throwing blade to rotate with the wheel. Simultaneously, the inclined side wall 10 of the channel 7 abuts the inclined side wall 23 of the throwing blade 12 providing reinforcement against displacement of the throwing blade in a circumferential direction. These functions of the side walls are reversed when the wheel is rotated in a counter clockwise direction.

Additional resistance to circumferential displacement is provided by the rigid connection of the lug 19 to the outer face 4 of the abrasive throwing wheel 1 when a bolt is passed through opening 20 in the lug 19 and secured in the taped opening 11 in the wheel 1. The lug thus acts as a stiffener for the throwing blades 12 without the need for abutments or other supports on the rear surface 14 of the blade.

Axial displacement of the throwing blade in one direction is prevented by contact between the bottom surface 17 of the throwing blade and the base portion 8 of the channel. Axial displacement of the throwing blade in the opposite direction is prevented by the dove tail union of the inclined walls of the blade and the channel and by the rigid connection formed by passage of the bolt through the opening 20 in lug 19 into the tapped opening 11 in the outer face 4 of the abrasive throwing wheel 1.

The dove tail configuration of the blade and channel aids in the installation of the blade in the wheel. The loose fit between the channel in the abrasive throwing wheel and the throwing blade before the lug 19 contacts outer face 4 and before the blade is seated in position provides minimal resistance when sliding the throwing blade into position. The loose fit also allows the throwing blade to slide easily in the channel even without perfect alignment of the throwing blade in the channel. Indeed, the taper resulting from the diminishing cross-section causes the walls of the channel to urge the throwing blade into proper alignment in the channel during the insertion process.

It has surprising been found that the tapered, dove tail configuration of the blade and channel aids in blade removal. In prior art devices, the blade had a tendency to "freeze" or become jammed in the grooves in the wheel making removal of the blade from the channel very difficult. In the blast wheel assembly of the present invention, however, the throwing blades can be easily removed from the abrasive throwing wheel, notwithstanding the dove tail configuration. It has been shown that a blade that is lodged in the channel can be freed by tapping or striking the blade with a dislodging force. Because the channel increases in cross-section from the center of the wheel to its periphery, the blade can be easily removed through the ever-increasing cross-sectional space as the blade is drawn out of the channel. The tapered fit between the throwing blade and the channel does not retard withdrawal of the throwing blade from the channel. For example, restraint against removal of the throwing blade from the channel is continually eased as the throwing blade is drawn out of the channel toward its outer end.

The throwing blade and the abrasive throwing wheel of this invention are particularly advantageous because they can be used with commercially available centrifugal blasting machines. For instance, the device of this invention can be employed with an impeller of the type described in U.S. Pat. No. 3,867,791.

Typically, the centrifugal blasting machine of this invention will be driven by a belt connected to a motor or by direct connection to a motor shaft. The latter method is preferred. One can employ either a locked bearing or a floating motor shaft. The latter is preferred and can be employed with the impeller and control cage arrangement disclosed in U.S. Pat. No. 3,867,791. Therein a control cage is disclosed, which does not wrap around the surface of the impeller as is conventional in the art. The impeller is generally mounted on the motor shaft, and when the impeller and motor shaft move inward and outward, as is common with a motor having a floating motor shaft, there is no interference between the control cage and the impeller.

Conventional impellers can also be employed in practicing this invention. The preferred impeller described in U.S. Pat. No. 3,867,791 can be employed. Therein, it is described that the impeller comprises a plurality of fingers that extend in a longitudinal direction. The outermost ends of the fingers are not connected to each other and openings are thereby formed between the fingers. The fingers are immediately adjacent the feed spout when the centrifugal blasting machine is assembled. This makes it possible to feed relatively large quantities of abrasive material to the impeller. Of course, it will be understood that conventional impellers in which the fingers are connected at their outermost ends can also be employed.

While this invention has been described in connection with a centrifugal blasting machine comprised of a single wheel disk, it will be understood that two wheel disks maintained in spaced apart relation can also be employed.

There are a number of advantages associated with this invention. First of all, means are provided for rigidly securing a throwing blade to a blasting wheel. Movement of the blades in a radial direction is substantially prevented making for a very safe device. The blades can be removed relatively easily and quickly replaced. Special assembly and disassembly tools are not required. Lost production time is minimized because of the ease and speed with which blades can be serviced or replaced. It is not necessary to remove any of the internal parts in the centrifugal blasting machine to replace the blades according to this invention. The locking design of this invention can be adapted to any length or width of blade.

What is claimed is:

1. A blast wheel assembly comprising an abrasive throwing wheel and a plurality of throwing blades evenly spaced axially on said wheel;

wherein said wheel comprises a substantially right cylindrical cross-section having a lateral surface defining a circumferential outer face of said wheel, a central opening, and a plurality of channels therein for receipt of said throwing blades, said channels extending from the lateral surface with a diminishing cross-section toward said central opening;

an opening in the lateral surface of said wheel for insertion of a fastner;

wherein each of said blades comprises an inner end, an outer end, a surface for throwing abrasive, and a bottom surface substantially perpendicular to said surface for throwing abrasive and diminishing in cross-section from said outer end to said inner end;

a lug disposed proximate said outer end and between said outer end and said inner end of said blade;

wherein said lug has an opening therein adapted to align with said opening in the lateral surface of said wheel when said blade is inserted in one of said channels in said wheel; and wherein each channel and the bottom of each blade are of complementary dove tail shape so that said channel slidably receives said blade and engages said blade to securely position said blade in said channel.

2. The blast wheel assembly as claimed in claim 1, wherein the opening in the lateral surface of the wheel extends from the lateral surface of the wheel toward the central opening along a radius of the wheel.

3. The blast wheel assembly as claimed in claim 2, wherein the opening in the lateral surface of the wheel is threaded.

4. The blast wheel assembly as claimed in claim 3, wherein the opening in the lug of the throwing blade is threaded.

5. The blast wheel assembly as claimed in claim 4, wherein at least one of said throwing blades is further secured to said wheel by a fastner threaded into the opening in the lateral surface of the wheel through the lug of the throwing blade.

* * * * *

UNITED STATES PATENT AND TRADEMARK OFFICE

CERTIFICATE OF CORRECTION

PATENT NO. : 6,447,378 B1
DATED : September 10, 2002
INVENTOR(S) : Thomas M. Hoff It is certified that error appears in the above-identified patent and that said Letters Patent is hereby corrected as shown below:

Title page,
Item [73], Assignee, "Siminole" should read -- Seminole --.

Column 9,
Line 32, "fastner" should read -- fastener --.

Column 10,
Line 28, "fastner" should read -- fastener --.

Signed and Sealed this

Thirty-first Day of December, 2002

JAMES E. ROGAN
*Director of the United States Patent and Trademark Office*